US006561759B1

(12) United States Patent
Muschelknautz

(10) Patent No.: US 6,561,759 B1
(45) Date of Patent: May 13, 2003

(54) FAN

(75) Inventor: Claudius Muschelknautz, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/868,003

(22) PCT Filed: Sep. 5, 2000

(86) PCT No.: PCT/DE00/03402

§ 371 (c)(1),
(2), (4) Date: Jun. 12, 2001

(87) PCT Pub. No.: WO01/31204

PCT Pub. Date: May 3, 2001

(30) Foreign Application Priority Data

Oct. 26, 1999 (DE) ..... 199 51 369

(51) Int. Cl.[7] ..... F04D 29/66
(52) U.S. Cl. ..... 415/119; 415/214.1
(58) Field of Search ..... 415/119, 204, 415/206, 214.1

(56) References Cited

U.S. PATENT DOCUMENTS 2,267,275 A 12/1941 Gevrenz
4,865,517 A * 9/1989 Beehler ..... 415/214.1 X
5,266,753 A 11/1993 Goehre
5,454,690 A 10/1995 Wolfe
5,894,114 A 4/1999 Eigenmann
6,206,633 B1 * 3/2001 Nakamura et al. ... 415/214.1 X

FOREIGN PATENT DOCUMENTS

| | | |
|---|---|---|
| DE | 42 05 489 A1 | 3/1993 |
| DE | 196 31 664 A1 | 2/1998 |
| EP | 0 840 063 A | 5/1998 |
| EP | 0 872 643 A | 10/1998 |
| FR | 1 519 407 A | 7/1968 |

* cited by examiner

*Primary Examiner*—Edward K. Look
*Assistant Examiner*—Richard A. Edgar
(74) *Attorney, Agent, or Firm*—Michael J. Striker

(57) ABSTRACT

The invention is based on a blower (10) with an electric motor (52) whose drive shaft (40) supports a radial impeller (30) whose blower housing (14), in an end face wall (20), has an inlet opening (24) through which air is aspirated and which is adjoined by a sound damper (12) whose housing (16) is fastened to the blower housing (14) with fastening elements, wherein a common end wall (20) is provided between the housing (16) and the blower housing (14).

Figure 1:
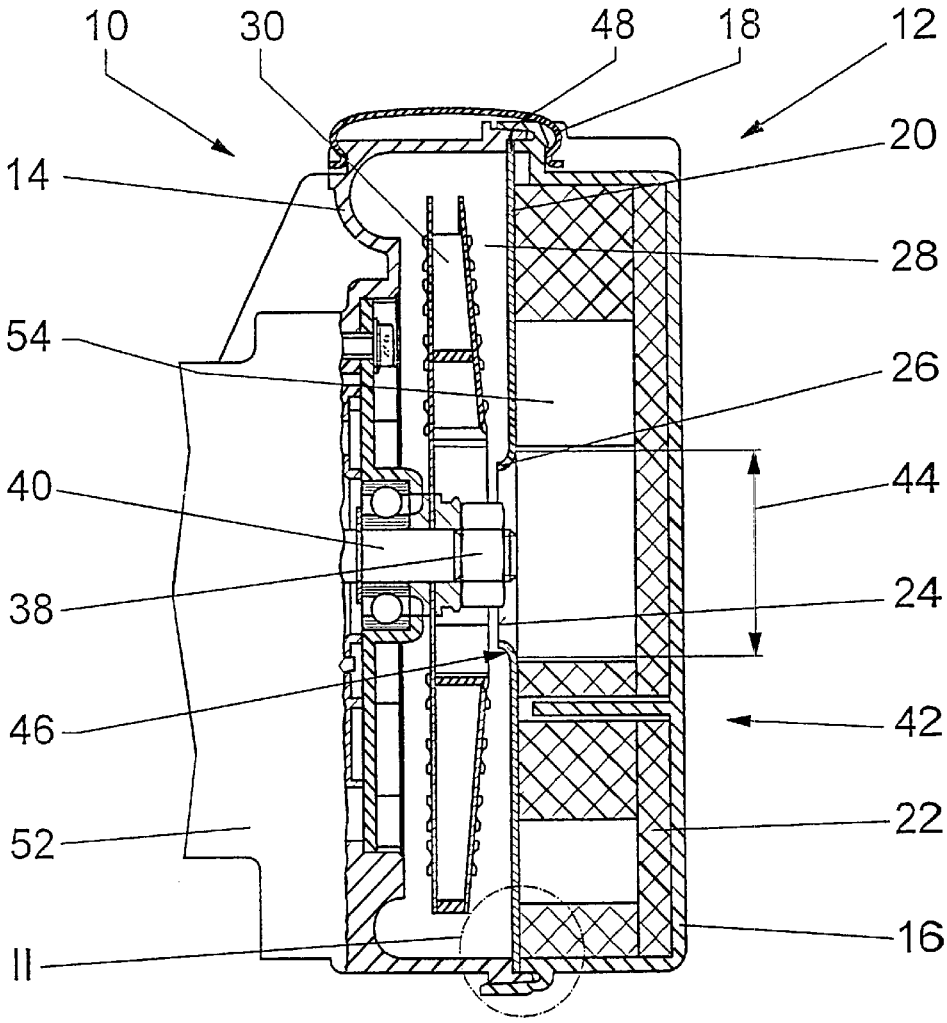

It is proposed that the housing (16) of the sound damper (12) constitute the end wall (20) of the blower housing (14) and define the chamber (28) for the impeller (30).

7 Claims, 1 Drawing Sheet

FAN

The invention is based on a blower according to the preamble to claim 1.

PRIOR ART

In reciprocating piston engines with three-way catalytic converters, particularly during a cold start, fresh air is blown into the exhaust system by means of secondary blowers in order to initiate an exothermic afteroxidation of uncombusted carbon compounds. The combustion process reduces the amounts of carbon monoxide and hydrocarbons in the exhaust and it is possible to rapidly bring the catalytic converter to a favorable operating temperature.

The blowers produce a large amount of noise, particularly when high flow speeds and an intense pressure increase are produced with high speeds. In order to reduce the noise, the fresh air can be aspirated through an air filter of the reciprocating piston engine. Additional lines are required for this, though, which involves higher costs. If the fresh air is aspirated from the outside air through an unsealed opening, then as a rule separate sound dampers are used in the intake region.

DE 42 05 489 A1 has disclosed a blower whose sound damper is mounted on the blower as a separate component. It has a housing cup with a flat cup bottom, a cup wall, and a housing cover that closes the cup opening. An air inlet opening in the cup wall and an air outlet conduit with a central opening in the housing cover are connected by means of a spiral conduit which is constituted by an insulating insert made of open-pored sound absorption material. In the axial direction of the sound damper, the conduit reaches from the cup bottom to the housing cover and is axially defined by these parts. The sound damper is built into an intake line of the blower by means of a connection fitting. Sound dampers of this kind can also be used for other purposes, in particular in blowers for ventilation systems of motor vehicles.

DE 196 31 664.2 has disclosed a blower with a sound damper, which has a housing with an air inlet opening on the circumference and an air outlet conduit with an air outlet opening at one end. The air outlet opening is disposed in the center or off center and is connected to an inlet opening in an end wall of the blower housing. The housing of the sound damper is fastened to the blower housing and is open in the direction of the blower, wherein the end wall serves as a common dividing wall between the blower housing and the housing of the sound damper, which has no housing cover. One layer of the sound absorption material rests directly against the blower housing. Thus the sound damper does not require a housing cover and the sound radiation of the blower is reduced.

In order to be able to mount an impeller of the blower on a drive shaft, the blower housing is divided in a plain lateral to the drive shaft. The two parts ate screw connected to each other. To that end, the parts of the blower housing have cylindrical fitting surfaces on the circumference. Bearing surfaces and fastening elements are likewise required in order to fasten the sound damper to the blower.

ADVANTAGES OF THE INVENTION

According to the invention, the housing of the sound damper constitutes the end wall of the blower housing and defines the chamber for the impeller. Before installation of the sound damper, the impeller can be mounted from the open end. Then, the opening of the blower housing is closed by the housing of the sound damper. This consequently replaces a part of the blower housing, thus reducing the number of parts, assembly- and fitting surfaces, and connecting means. Assembly is also simplified. In addition, the blower is shorter in the axial direction and the structure as a whole is lighter in weight.

In a suitable fashion, on its side oriented toward the blower housing, the housing of the sound damper has a collar which is inserted into a recess in the blower housing. This centers the two parts in relation to each other, wherein the sound damper can be rotated in relation to the blower around the drive axis so that the position of its air inlet opening can be easily adapted to the installation conditions in the vehicle. Advantageously, the housing of the sound damper has an additional collar formed onto it which overlaps the blower housing circumferentially. Consequently, the blower is sealed in this region so that no outside air can get into the blower and no sound can escape to the outside.

Since the sound damper according to the invention covers the entire end face of the blower, the sound radiating surface area of the blower housing is sharply reduced. In addition, the large circumference of the sound damper allows for longer conduit which likewise has a positive effect on the sound damping.

The housing of the sound damper is fastened to the blower housing by means of retaining clips, which simplifies assembly and disassembly and facilitates the alignment of the sound damper. In addition, the blower housing can be manufactured more inexpensively since fixing devices are no longer required for the fastening elements.

According to one embodiment of the invention, oriented toward the impeller, the sound damper has a disk which is preferably made of sheet metal and is clamped between the sound damper and the blower housing, thus constituting the common dividing wall. It is likewise inserted into the end face recess on the blower housing and is centered along the circumference. The sheet metal disk can be easily modified in thickness and shape, as a result of which the sound radiation spectrum can be matched to the installation conditions. Simultaneously, the insulating action is improved by the mass of the material.

In the center, the sheet metal disk has an inlet opening with a collar formed onto it which protrudes into the chamber for the impeller. The air flows into the chamber with the impeller through this inlet opening. The diameter of the inlet opening and/or the radius at the formed collar can be adapted to the optimal operating point of the blower in a simple way.

DRAWINGS

Further advantages ensue from the following description of the drawings. An exemplary embodiment of the invention is shown in the drawings. The drawings, the specification, and the claims contain numerous characteristics in combination. The specialist will also appropriately consider the characteristics individually and will combine them into other logical combinations.

Figure 2:
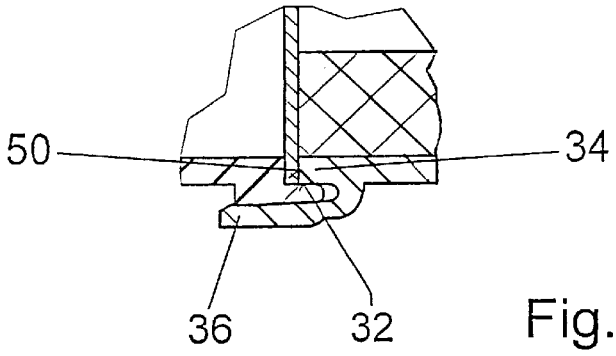

FIG. 1 shows a partial longitudinal section through a blower according to the invention and FIG. 2 shows an enlarged detail indicated with the dashed line II in FIG. 1.

DESCRIPTION OF THE EXEMPLARY EMBODIMENTS

An electric motor 52 of a blower 10 drives an impeller 30, which is fastened to a drive shaft 40 by means of a nut 38.

The impeller 30 revolves in a chamber 28 in a blower housing 14 is mounted from an open end face. The opening is closed by a sound damper 12, whose housing 16 includes a disk 20, preferably made of sheet metal, which is held between the blower housing 14 and the sound damper 12 and constitutes a common dividing wall between the chamber 28 and the sound damper 12.

To this end, the blower housing 14 has a recess 32 into which a disk 20 made of sheet metal is inserted at the end face and this disk 20 is centered along its outer diameter 48 in this recess.

The housing 16 of the sound damper 12 contains sound absorption material 22 in which spiral-shaped air conducting conduits 54 are provided. These conduits are connected to an intake opening, not shown in detail, on the circumference of the housing 16 and lead to an inlet opening 24 in the disk 20. The inlet opening 24 is embodied as funnel-shaped by virtue of the fact that it is encompassed by a collar 26, which is formed onto the disk 20 and has a transition radius 46 toward the chamber 28. The diameter 44 of the inlet opening 24 and the transition radius 46 can be adapted to the optimal operating point of the blower 10 for each intended application.

The sound damper 12 is preassembled and is then connected to the blower 10 in the direction 42. To this end, on its side oriented toward the blower housing 14, the housing 16 of the sound damper 12 has a collar 34 formed onto it which is likewise inserted into the recess 32 at the end face. This collar consequently constitutes a radial support surface and with its end face 50 simultaneously fixes the disk 20 in the axial direction. An additional collar 36 formed onto the housing 16 of the sound damper 12 encompasses the blower housing 14 over its entire circumference. Advantageously, the housing 16 of the sound damper 12 and the blower housing 14 are clamped by means of a number of retaining clips 18.

The sound absorption material 22 extends to the disk 20 which separates the sound damper 12 from the chamber 28 for the impeller 30 and, during installation, is slightly compressed so that it is prestressed against the disk 20.

REFERENCE NUMERALS

10 blower
12 sound damper
14 blower housing
16 housing
18 retaining clip
20 disk
22 sound absorption material
24 inlet opening
26 collar
28 chamber
30 impeller
32 recess
34 collar
36 collar
38 nut
40 drive shaft
42 direction
44 diameter
46 radius
48 outer diameter
50 end face
52 electric motor
54 air conducting conduit

What is claimed is:

1. A blower (10) with an electric motor (52) whose drive shaft (40) supports a radial impeller (30) having a blower housing (14), wherein a common end wall (20) is provided between a housing (16) for a sound damper (12) and the blower housing (14), wherein said common end wall (20) has an inlet opening (24) through which air is aspirated and which is adjoined by the sound damper (12) whose housing (16) is fastened to the blower housing (14) with fastening elements, characterized in that the housing (16) of the sound damper (12) constitutes the common end wall (20) of the blower housing (14) and defines a chamber (28) for the impeller (30), wherein the common end wall of the housing (16) is constituted by a disk (20), wherein said disk is clamped between the sound damper (12) and the blower housing (14), wherein the disk (20) is stamped out of sheet metal and has a funnel-shaped inlet opening (24) in the center, with a collar (26) formed onto it, where said collar protrudes into the chamber (28) for the impeller (30).

2. The blower (10) according to claim 1, characterized in that the housing (16) of the sound damper (12) is fastened to the blower housing (14) by means of retaining clips (18).

3. The blower (10) according to claim 1, characterized in that the sound damper (12) contains sound absorption material (22) which encompasses air conduits and is prestressed against the common end wall (20).

4. The blower (10) according to claim 1, characterized in that the blower housing (14) is an integral component of a housing of the electric motor (52).

5. The blower (10) according to claim 1, characterized in that the sheet metal disk (20) rests in a recess (32) of the blower housing (14) and is guided along its outer diameter (28).

6. The blower (10) according to claim 5, characterized in that on its side oriented toward the blower (10), the housing (16) of the sound damper (12) has a collar (34) which is inserted into the recess (32) of the blower housing (14) along with the sheet metal disk (20).

7. The blower (10) according to claim 6, characterized in that on its side oriented toward the blower (10), the housing (16) of the sound damper (12) has an additional collar (36) which overlaps the blower housing (14) along its circumference.

* * * * *